US005408709A

United States Patent [19]

Lockwood

[11] Patent Number: 5,408,709

[45] Date of Patent: Apr. 25, 1995

[54] SHOWER CONTROL ASSEMBLY

[76] Inventor: George H. Lockwood, 2125 NE. 27th Dr., Wilton Manors, Fla. 33306

[21] Appl. No.: 841,246

[22] Filed: Feb. 24, 1992

Related U.S. Application Data

[63] Continuation of Ser. No. 518,547, May 3, 1990, abandoned.

[51] Int. Cl.[6] ..... A47K 3/22

[52] U.S. Cl. ..... 4/605; 251/46

[58] Field of Search ..... 4/567, 568, 570, 597, 4/605; 251/45, 46

[56] References Cited

U.S. PATENT DOCUMENTS

| | | | |
|---|---|---|---|
| 269,886 | 1/1883 | Semple | 251/46 |
| 595,061 | 12/1897 | Gulland | 251/25 |
| 668,202 | 2/1901 | Nethery | 251/25 |
| 681,172 | 8/1901 | Koenig | 251/25 |
| 2,000,791 | 5/1935 | Schmiedeknecht | 4/192 |
| 2,761,733 | 9/1956 | Preus | 239/562 |
| 2,839,264 | 6/1958 | Trubert | 251/57 |
| 2,846,691 | 8/1958 | Zettinig | 4/192 |
| 2,854,998 | 10/1958 | MacGlashan, Jr. et al. | 251/324 X |
| 2,876,981 | 3/1959 | McNown | 251/46 X |
| 2,986,163 | 5/1961 | Bunce | 137/606 |
| 3,222,690 | 12/1965 | Noakes | 4/194 |
| 3,231,236 | 1/1966 | Hodel et al. | 251/324 |
| 3,375,532 | 4/1968 | Gellmann | 4/192 |
| 3,461,870 | 8/1969 | Van Linge | 4/596 X |
| 3,712,578 | 1/1973 | Dawson | 251/46 X |
| 3,805,822 | 4/1974 | Joannon | 251/46 X |
| 3,895,645 | 7/1975 | Johnson | 251/46 |
| 3,971,074 | 7/1976 | Yxfeldt | 4/570 |
| 4,105,186 | 8/1978 | Eby | 251/46 X |
| 4,134,573 | 1/1979 | Messinger | 251/324 |
| 4,135,696 | 1/1979 | Saarem et al. | 251/46 X |
| 4,244,554 | 1/1981 | Di Mauro et al. | 251/45 X |
| 4,398,668 | 8/1983 | Jette | 4/596 X |
| 4,497,444 | 2/1985 | Arnold | 239/587 |
| 4,563,780 | 1/1986 | Pollack | 4/192 |
| 4,573,639 | 3/1986 | Logue | 4/567 X |
| 4,630,644 | 12/1986 | Hafner et al. | 251/28 X |
| 4,651,930 | 3/1987 | Magaha, Jr. | 239/318 |
| 4,685,156 | 8/1987 | Brabazon | 4/194 |
| 4,729,135 | 3/1988 | Titterington | 4/597 |
| 4,917,294 | 4/1990 | Bergmann et al. | 251/45 X |
| 4,934,000 | 6/1990 | Freedman | 4/615 |

FOREIGN PATENT DOCUMENTS

| | | | |
|---|---|---|---|
| 2165271 | 4/1986 | United Kingdom | 4/DIG. 15 |
| 854364 | 8/1981 | U.S.S.R. | 4/605 |

*Primary Examiner*—Robert M. Fetsuga

*Attorney, Agent, or Firm*—Herbert L. Lerner; Laurence A. Greenberg

[57] ABSTRACT

A flow control assembly regulates the flow of water from a shower head independently from the normal valving system. A control valve is located upstream of the shower head, as seen in the water flow direction, and is operated by a conveniently located pilot valve.

2 Claims, 4 Drawing Sheets

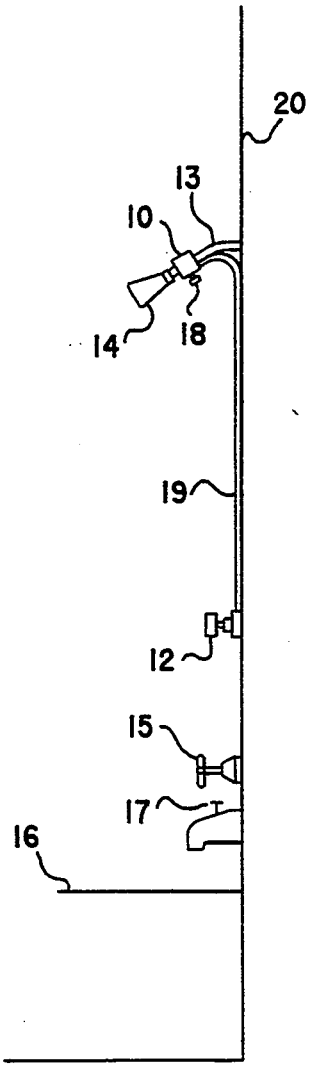
FIG.1
FIG.2
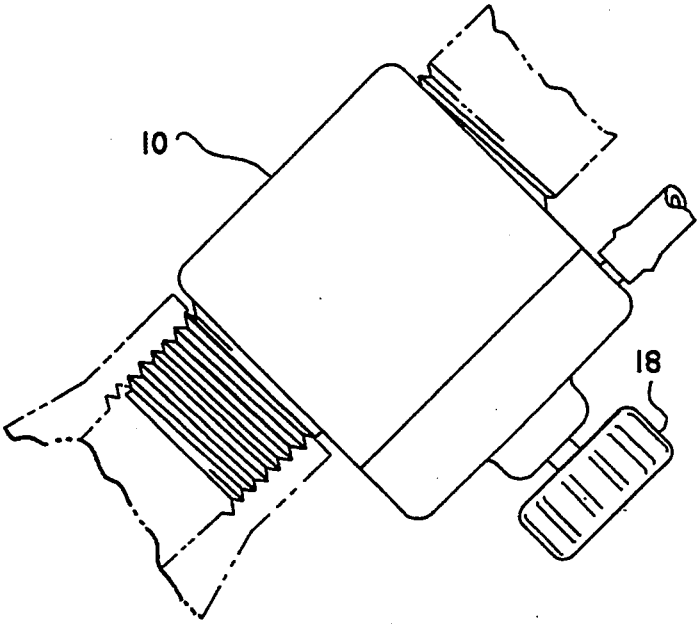
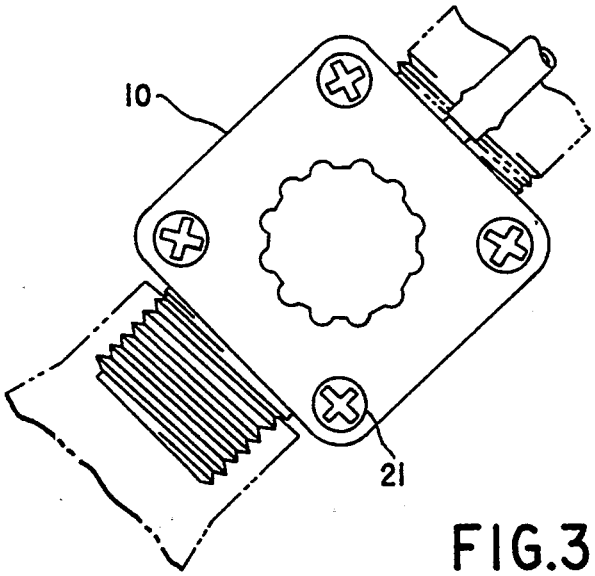
FIG.3

SHOWER CONTROL ASSEMBLY

This application is a continuation of application Ser. No. 518,547, filed May 3, 1990, now abandoned.

BACKGROUND OF THE INVENTION

1. Field of the Invention

The invention relates to a shower or valve control assembly for the control of water from a shower head, such as is commonly used in personal shower baths.

2. Description of the Related Art

Methods have been disclosed heretofore for providing such control. According to U.S. Pat. No. 4,651,930, detergent is aspirated from a bottle through a shower head. In U.S. Pat. No 4,398,668, a shower arm is connected to existing hot and cold water ports for varying water temperature and shutting off water flow from a shower head. U.S. Pat. No. 4,729,135 discloses a foot-actuated valve for opening and closing a shower valve with a fluid control and U.S. Pat. No. 2,839,264 similarly relates to a foot-actuated cock for a shower head. Finally, U.S. Pat. No. 2,761,733 relates to a remote control system for a garden sprinkler. However, all such systems have disadvantages to be discussed below.

Shower baths are typically equipped with a spray type shower head which is supplied with water under pressure from sources of both hot and cold water. The desired temperature of the water from the shower head is attained by adjusting the valves controlling the hot and cold water supplies. These valves may be separate units or combined into one single control. The flow rate from the shower head is also regulated by adjusting the hot and cold water valves or the single control valve. Some showers are equipped with a flow control valve at the shower head.

During the act of showering, it is desirable to turn the water off and on frequently to conserve water as well as for personal convenience. It is also a safety feature, especially for children, to be able to quickly and easily turn the water off if for any reason it becomes uncomfortable.

Prior to the invention of the instant application, there had been no convenient way of stopping the flow of water without necessitating readjustment of the temperature or flow rate or both when the shower was restarted. When two independent valves are provided, they must be completely readjusted for both temperature and flow rate. If a single combined control is provided, it is too sensitive to be returned to exactly the desired temperature and flow rate. The single independent valve at the shower head can be used to turn the shower on and off without effecting the temperature adjustment but it must be reset to control the flow and it is inconveniently high, difficult to operate and impossible for children to use.

It is accordingly an object of the invention to provide a shower control assembly, which overcomes the hereinafore-mentioned disadvantages of the heretofore-known devices of this general type and which meets the following are objects of the invention.

1. To provide a shower control which can be used to turn the shower on and off without affecting the water temperature adjustments.
2. To provide a shower control for turning the shower water on and off quickly and at a convenient location.

3. To provide a shower control having means for controlling the flow of water which has an adjustment unaffected by turning the water on or off.

SUMMARY OF THE INVENTION

With the foregoing and other objects in view there is provided, in accordance with the invention, in a shower bath having a shower head, a hot and cold water supply, and a valving system for discretely mixing hot and cold water from the supply for discharge through the shower head, a shower control assembly comprising a control valve upstream of the shower head to be switched between an open condition permitting flow and a closed condition preventing flow; and a pilot valve hydraulically connected to the control valve, the pilot valve being operable in a first position switching the control valve into the open condition and a second position switching the control valve into the closed condition, the pilot valve remaining in one of the first and second positions without continued application of force.

In accordance with another feature of the invention, the control valve includes means for adjusting the flow rate of water through the shower head when the control valve is in the open condition.

In accordance with a further feature of the invention, there are provided means for mounting the pilot valve on a shower bath wall.

In accordance with an added feature of the invention, the control valve includes a diaphragm being selectively movable between a position permitting flow of water and a position preventing flow of water.

With the objects of the invention in view, there is also provided a valve control assembly, comprising a control valve for controlling discharge of water from a pressurized source, a valve member movable in the control valve between an open condition permitting flow of water and a closed condition preventing flow of water, and a pilot valve disposed remote from and connected to the control valve for controlling the control valve with fluid flowing between the control valve and the pilot valve, the pilot valve being selectively operable by external application of force between a first position moving the valve member into the open condition and a second position moving the valve member into the closed condition.

In accordance with an additional feature of the invention, the valve member is a diaphragm constructed of an elastomeric material.

With the objects of the invention in view, there is furthermore provided a valve control assembly, comprising a control valve having a control valve body with a valve seat, a water entrance passage upstream of the valve seat, a water exit passage downstream of the valve seat and a water passage, a diaphragm between the valve seat and the water passage being movable away from the valve seat providing an open condition and toward the valve seat providing a closed condition between the water entrance and exit passages, a tube communicating with the water passage, a pilot valve having a pilot valve body with an entrance port communicating with the tube, a bore communicating with the entrance port and a valve exit port communicating with the bore, and a valve spool in the bore being movable between a first position moving the diaphragm into the open condition and a second position moving the diaphragm into the closed condition.

In accordance with a concomitant feature of the invention, there are provided means for manually adjusting the position of the diaphragm in the open condition, and means for manually selecting the position of the valve spool.

Control of the flow of water from the shower head is effected by a pilot and slave valve arrangement wherein the slave valve is in the flow path of the shower head water and is operated by the pilot valve which is located at any convenient location. The slave valve controls the rate of flow of water from the shower head without changing the temperature.

Thus the invention includes two separate but cooperating valves. The main functional valve is located upstream in the supply conduit to the shower head. This valve is a slave and is operated by a pilot valve mounted at any convenient location. The main valve is so constructed that it can be turned on or off by operation of the pilot valve. The main valve also has a flow control member which can be adjusted so that the flow rate returns to the preset amount whenever the shower is turned on.

Other features which are considered as characteristic for the invention are set forth in the appended claims.

Although the invention is illustrated and described herein as embodied in a shower control assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

FIG. 1 is a fragmentary, diagrammatic, side-elevational view of the shower control assembly of the invention installed in a typical tub or shower bath;

FIG. 2 is an enlarged fragmentary, side-elevational view of a main valve of the assembly;

FIG. 3 is a fragmentary, bottom-plan view of the main valve;

DESCRIPTION OF THE PREFERRED EMBODIMENT

Figure 4:
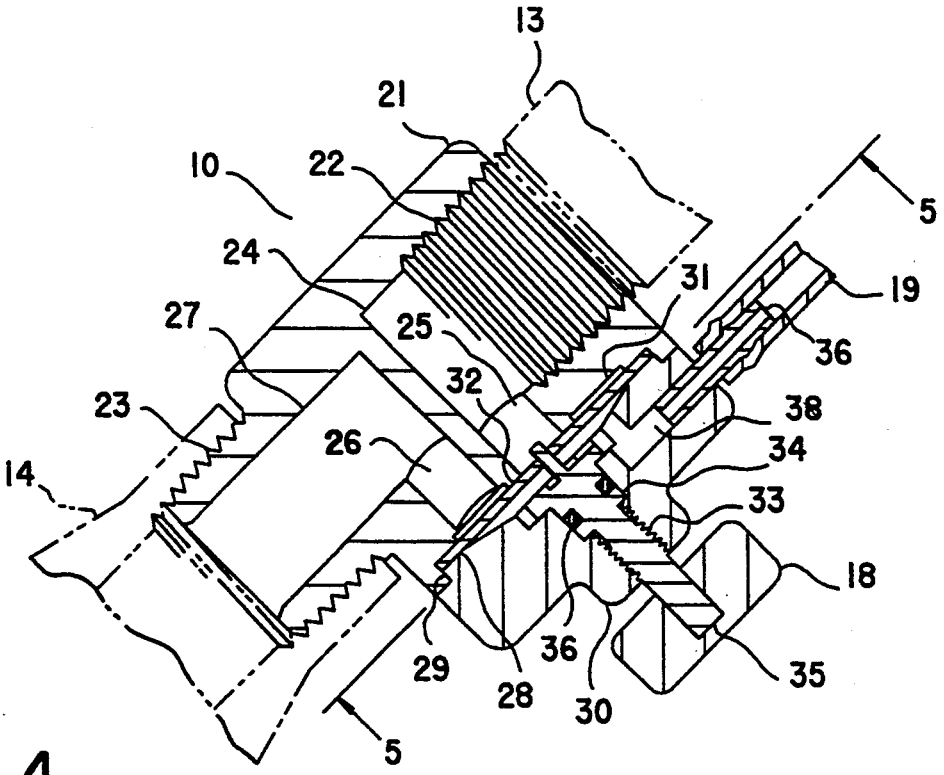
FIG. 4 is a fragmentary, vertical-sectional view of the main valve in the closed condition.

Referring now to the figures of the drawing in detail and first, particularly, to FIG. 1 thereof, there is seen a shower control constructed in accordance with a preferred embodiment of the invention and installed in a typical shower bath. A main control valve indicated by reference numeral 10 is installed just upstream of a shower head 14 on a supply pipe 13. The main valve 10, which has a flow control adjusting knob 18 to be discussed in more detail below, is connected to a pilot valve 12 by means of a tube 19 and the pilot valve is mounted on a shower wall 20. Water temperature is controlled by adjusting one or two valves given reference numeral 15. Water from the valves 15 normally flows into a bathtub 16 through a faucet but can be diverted to the shower head by pulling up on a diverter knob 17 on the faucet which will remain in the diverting position until pushed down or until the valves 15 are turned off.

The main control valve 10 is shown on a larger scale in FIG. 2 and the structure thereof is shown in detail in FIG. 4. A valve body 21 is constructed of a rigid material and has internal threads 22 for attachment to the supply pipe 13 shown in phantom, as well as external threads 23 for attaching the shower head 14 which is also shown in phantom. A water entrance passage 24 terminates in a valve orifice 25. A water exit orifice 26 connects into a water exit passage 27 permitting direct flow therefrom into the shower head 14.

A valve member in the form of a diaphragm 28 is constructed of an elastomeric material so as to be flexible and is located in a counterbore 29 formed in the valve body 21. In the following description, the upper surface of the diaphragm 28 is understood to be the surface thereof facing the orifices 25 and 26 and upward movement of the diaphragm will be in the direction toward those orifices. The lower surface and downward movement is understood to be opposite to the upper surface and upward movement. A valve bonnet 30 is fitted to the counterbore 29 and held in place by screws 31 shown in FIG. 3. The diaphragm 28 is the valving element and its operation will be explained below. It also functions as a gasket to make a pressure tight seal between the valve body 21 and the valve bonnet 30.

Figure 5:
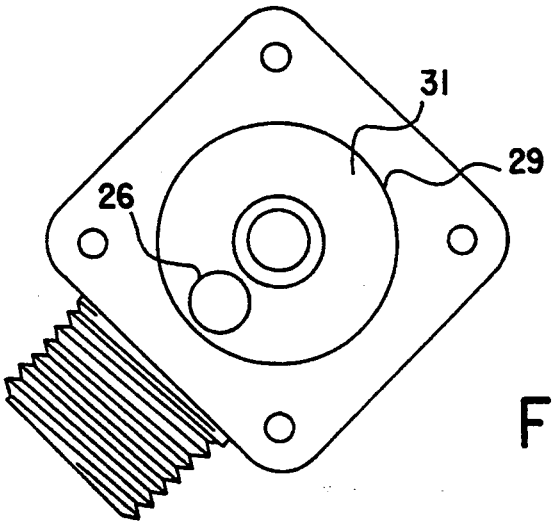
FIG. 5 is a side-elevational view of the main valve body taken along the line 5—5 in FIG. 4, in the direction of the arrows, with all of the other parts removed.

A valve seat 32 is formed in the valve body 21 at the upper surface of the diaphragm 28. The valve seat 32 has a shallow cylindrical relief 32' formed therein in the shape of annular ring. This is best seen in FIG. 5.

The valve bonnet 30 has a threaded bore 33 and a straight bore 34 formed therein, in which a flow control screw 35 is rotatably fitted and sealed with an O-ring 36. The flow control adjusting knob 18 is rigidly attached to the flow control screw 35 by a set screw or other conventional means which are not shown. A barbed tubing connector 36 is pressed into the bonnet 30 as means for making a pressure tight connection with the tube 19. A water passage 38 connects a space at the lower surface of the diaphragm 28 with the tubing connector and hence with the tube 19.

Figure 6:
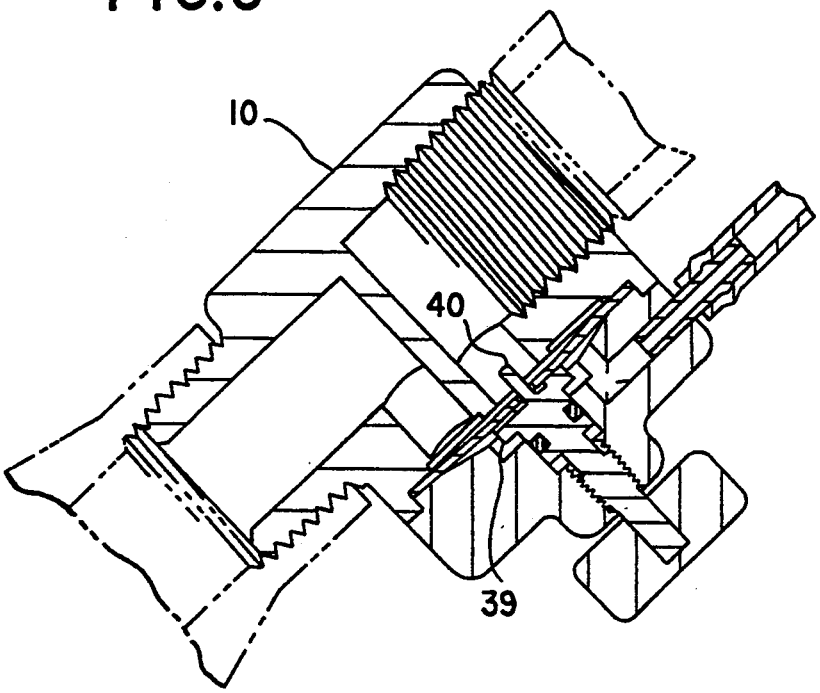
FIG. 6 is a view similar to FIG. 4 showing the main valve in the open condition.

The flow control screw 35 has an enlarged diameter portion 39 indicated in FIG. 6, with a serrated upper surface acting as a limit or stop for downward movement of the diaphragm. Formed onto the upper end of the flow control screw is a small cylindrical projection 40 which is long enough to pass through a hole in the diaphragm. The hole in the diaphragm through which the projection 40 passes is slightly larger than the projection thereby permitting water to flow slowly from the upper surface of the diaphragm to the lower surface of the diaphragm.

Figure 7:
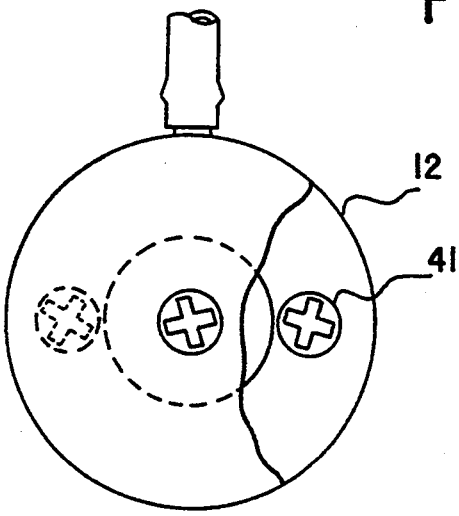
FIG. 7 is a fragmentary, partly broken-away, front-elevational view of a pilot valve of the assembly.
Figure 8:
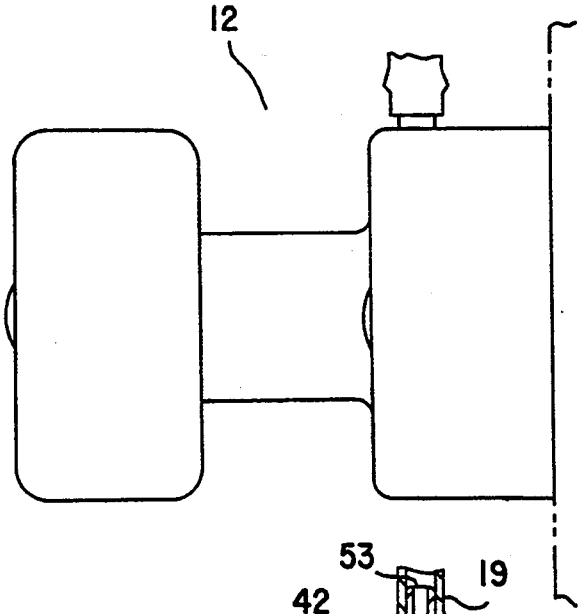
FIG. 8 is a fragmentary, side-elevational view of the pilot valve.
Figure 9:
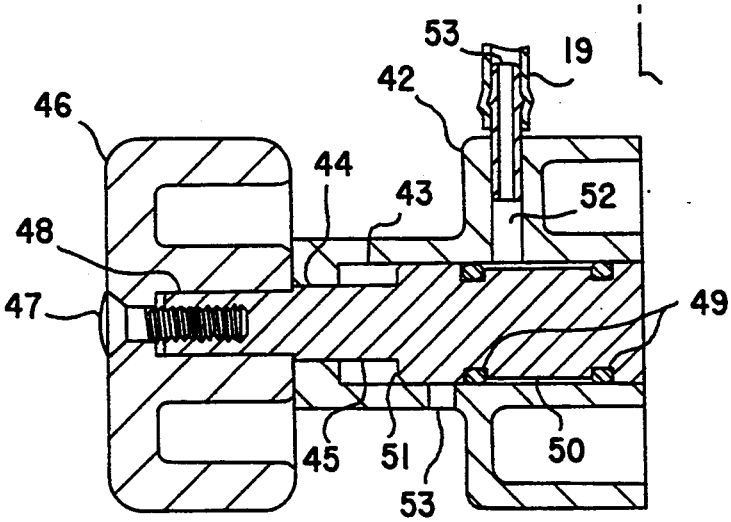
FIG. 9 is a fragmentary, vertical-sectional view of the pilot valve when positioned to stop the flow of water.
Figure 10:
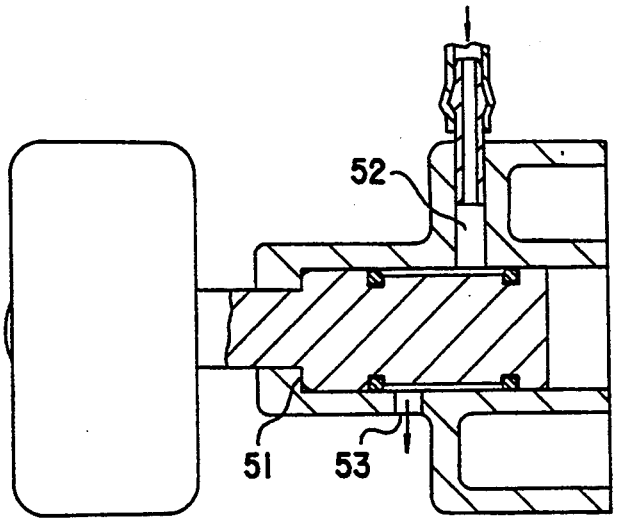
FIG. 10 is a partly vertical-sectional view of the pilot valve positioned to permit the flow of water.

The structure of the pilot valve 12 is best understood by describing FIGS. 9 and 10, although it is rigidly attached to the shower wall 20 by means of two suitable screws 41 shown in FIG. 7 and the outer structure thereof is shown in FIG. 8.

A pilot valve body 42 has a straight valve bore 43 terminating in a concentric valve stem bore 44 formed therein. A valve spool 45 is slideably fitted to the bores 43 and 44. The valve spool 45 is fitted with two O-rings 49 preventing water leakage from either end of a reduced diameter portion 50 of the valve spool.

A pilot valve operating knob 46 is attached by a screw 47 to a reduced diameter valve stem 48 and thereby limits the movement of the valve spool in an inward direction. The outward motion of the valve spool is limited by a shoulder 51 as shown in FIGS. 9 and 10.

The pilot valve body 42 has an entrance port 52 into which a barbed tubing connector 53 is pressed and receives the lower end of the tube 19. A valve exit port 54 exhausts free to the atmosphere and a non-illustrated shower drain.

The operation of the assembly can now be understood and will be explained below.

The shower is started with the pilot valve knob 46 in the first or out position, which permits water flow from the connecting tube 19 to be discharged through the entrance port 52, the reduced diameter portion 50 and the valve exit port 45, as seen by the arrows in FIG. 10. The hot and cold water valve or valves 15 are then turned on and adjusted to produce the desired water temperature. At this time water will flow through the supply pipe 13 and into the valve orifice 25. A very small amount of water flows through the center hole in the diaphragm 28 around the projection 40. Since the pilot valve is open, this small amount of water flows readily through the water passage 38, into the connecting tube 19 and is discharged. There is accordingly no appreciable pressure on the lower surface of the diaphragm and it is deflected downward by the incoming pressure on the upper surface thereof. Deflection of the diaphragm downward into the open condition of the diaphragm and therefore of the control valve when the pilot valve is in the first position, permits free flow of water through the valve orifice 25, past the valve seat 32 and into the exit orifice 26, the exit passage 27 and the shower head.

At this time the flow rate of the shower can be adjusted by turning the flow control adjusting knob 18 and limiting the downward movement of the diaphragm as shown in FIG. 6. This adjustment does not need to be changed for subsequent usage of the shower.

During the time that the shower is used, when it is desired to turn the water off, the pilot valve knob 46 can be pushed to its second or inward position thereby stopping the flow of water from the lower surface of the diaphragm. In this closed condition of the diaphragm and the control valve, the small flow of water through the hole in the diaphragm around the projection 40 creates pressure on the lower surface of the diaphragm equal to the incoming pressure at the valve orifice 25. It would appear that since the pressure on the upper surface of the diaphragm in the area outside the valve seat 32 is reduced As understood, this creates an imbalance of forces on the diaphragm causing it to move upward and stop the flow of water as shown in FIG. 4. In order to restart the flow of water, the pilot valve knob can be pulled out and flow will be at the rate and temperature previously set.

Modifications to the present invention will be apparent to those skilled in the art, therefore no limitation to the invention is intended by way of the description and the accompanying drawings.

I claim:

1. In a shower bath having a shower head, a hot and cold water supply, and a valving system for discretely mixing hot and cold water from the supply for discharge through the shower head, a shower water control assembly, comprising a control valve having a control valve body with a valve seat, a water entrance passage upstream of said valve seat, a water exit passage downstream of said valve seat communicating with the shower head and a water passage, a diaphragm between said valve seat and said water passage being movable away from said valve seat providing an open condition and toward said valve seat providing a closed condition between said water entrance and exit passages, a tube communicating with said water passage, a pilot valve having a pilot valve body with an entrance port communicating with said tube, a bore communicating with said entrance port and a valve exit port communicating with said bore and communicating directly with the atmosphere, and a valve spool in said bore being movable between a first position moving said diaphragm into said open condition and a second position moving said diaphragm into said closed condition, said pilot valve having means for maintaining said pilot valve in one of said first and second positions without continued application of force.

2. The water control assembly according to claim 1, including means for manually adjusting the position of said diaphragm in said open condition, and means for manually selecting the position of said valve spool.

* * * * *